US009415245B2

(12) United States Patent
Codega

(10) Patent No.: US 9,415,245 B2
(45) Date of Patent: Aug. 16, 2016

(54) ASSISTED SAFETY LOCKING DEVICE EQUIPPED WITH ANTI-PANIC DEVICE

(75) Inventor: Antonio Codega, Lecco (IT)

(73) Assignee: CAMP S.p.A., Premana, Lecco (IT)

( * ) Notice: Subject to any disclaimer, the term of this patent is extended or adjusted under 35 U.S.C. 154(b) by 96 days.

(21) Appl. No.: 13/547,087

(22) Filed: Jul. 12, 2012

(65) Prior Publication Data

US 2013/0032433 A1 Feb. 7, 2013

(30) Foreign Application Priority Data

Aug. 3, 2011 (EP) ..... 11425211

(51) Int. Cl.
*A62B 1/14* (2006.01)
*A63B 29/02* (2006.01)

(52) U.S. Cl.
CPC .. *A62B 1/14* (2013.01); *A63B 29/02* (2013.01)

(58) Field of Classification Search
CPC ..... A62B 1/14; A63B 29/02
USPC ..... 182/5, 6, 7, 71, 72, 192, 193; 24/132 R, 24/134 R, 134 KB; 188/65.1, 65.2, 65.5
See application file for complete search history.

(56) References Cited

U.S. PATENT DOCUMENTS 4,596,314 A * 6/1986 Rogelja ..... 188/65.5
5,054,577 A * 10/1991 Petzl et al. ..... 182/5
5,076,400 A * 12/1991 Petzl et al. ..... 188/65.5
5,360,083 A * 11/1994 Hede ..... 182/5
5,577,576 A * 11/1996 Petzl et al. ..... 188/65.4
5,597,052 A * 1/1997 Rogleja ..... 188/65.5
5,638,919 A * 6/1997 Pejout ..... 182/192
5,975,243 A * 11/1999 Lorbek ..... 182/193
6,029,777 A * 2/2000 Rogelja ..... 182/193
6,155,384 A * 12/2000 Paglioli ..... 188/65.2
6,732,833 B2 * 5/2004 Rogelja ..... 182/5
6,843,346 B2 * 1/2005 LeBeau et al. ..... 182/5
7,658,264 B2 * 2/2010 Mauthner ..... 182/5
7,845,467 B2 * 12/2010 Petzl et al. ..... 182/5
8,100,231 B2 * 1/2012 Petzl et al. ..... 188/65.5
8,348,016 B2 * 1/2013 Lewis et al. ..... 182/192
8,584,814 B2 * 11/2013 Chaumontet et al. ..... 188/65.1
2002/0112916 A1 * 8/2002 Ador ..... 182/5
2006/0207829 A1 * 9/2006 Mauthner ..... 182/5
2007/0215411 A1 * 9/2007 Petzl et al. ..... 182/193
2011/0048852 A1 3/2011 Wolf et al.

FOREIGN PATENT DOCUMENTS

EP 0688581 A1 12/1995
EP 1834672 A1 9/2007

(Continued)

*Primary Examiner* — Daniel Cahn
(74) *Attorney, Agent, or Firm* — Robert E. Alderson, Jr.

(57) ABSTRACT

Safety devices for sports and mountaineering activities are provided. In particular, such devices include a body that has a first and a second plate, both fixed, substantially parallel to one another and connected together at one end through a lever member hinged to both of the plates by a pin, so that, when assembled, said plates define space (a) in which a path for the rope is provided. The lever member can rotate around axis (b) between a release position and a holding position. The lever member also may include a fixed pulley, arranged on a portion of the lever member away from axis (b) so that a rope can slide along the fixed pulley about an axis offset with respect to axis (b) of the lever member. The devices also may include an anti-panic mechanism.

6 Claims, 7 Drawing Sheets

(56) References Cited

FOREIGN PATENT DOCUMENTS

| | | | |
|---|---|---|---|
| EP | 2246100 | A1 | 11/2010 |
| FR | 2647099 | A1 | 11/1990 |
| FR | 2919196 | A1 | 1/2009 |
| GB | 2141213 | A | 12/1984 |

* cited by examiner

ASSISTED SAFETY LOCKING DEVICE EQUIPPED WITH ANTI-PANIC DEVICE

CROSS REFERENCE TO RELATED APPLICATION

This application claims priority to and benefit of European Patent Application No. 11425211.7 filed Aug. 3, 2011, the contents of which are incorporated by reference in their entirety.

FIELD OF THE INVENTION

The present invention relates to safety devices, in particular for mountain activities involving descents by rope.

BACKGROUND OF THE INVENTION

An insurer and/or descender is a device used to carry out mountaineering or caving activities, which allows the user to descend using a rope.

The principle forming the basis of the operation of such devices exploits the friction between the rope and the insurer and/or descender, which tends to slow the downward movement of the climber.

The first tools used, which are still today in widespread use, have been joined by new ones, designed in order to make the activity safer overall, on the one hand allowing the rope to be locked more effectively and on the other hand adopting provisions that make it more difficult, if not actually impossible, to use the device incorrectly or in an unsafe manner.

For this purpose devices equipped with so-called anti-panic systems would be useful, capable of keeping the user safe even in situations in which full control of the device is lost for reasons such as inexperience or fatigue.

SUMMARY OF THE INVENTION

The purpose of the present invention is to provide self-locking devices for descending using a rope, which comprise a release mechanism of the rope equipped with an "anti-panic" system.

In particular, the self-locking device 1 of the present invention for going down a rope comprises a body (101) that comprises a first (2) and a second plate (3), both fixed, substantially parallel to one another and connected together at one end through a lever member (4) hinged to both of the plates (2,3) through a pin (35), so that, when assembled, said plates (2,3) define a space (d) in which a path for the rope (7) is defined, said lever member (4) being able to tilt between a release position and a holding position of said rope (7), said lever member (4) also comprising a fixed pulley (12), arranged on a portion of said lever member (4) that does not comprise the tilting pivot (9), said rope (7) being intended to slide on said fixed pulley (12) about an axis offset with respect to the axis of the tilting pivot (9) of the lever member (4), said first plate comprising an inner face (5) and an outer face (6), said outer face (6) comprising a housing for a release mechanism of the rope (7) and an anti-panic mechanism.

DETAILED DESCRIPTION

Figure 1:
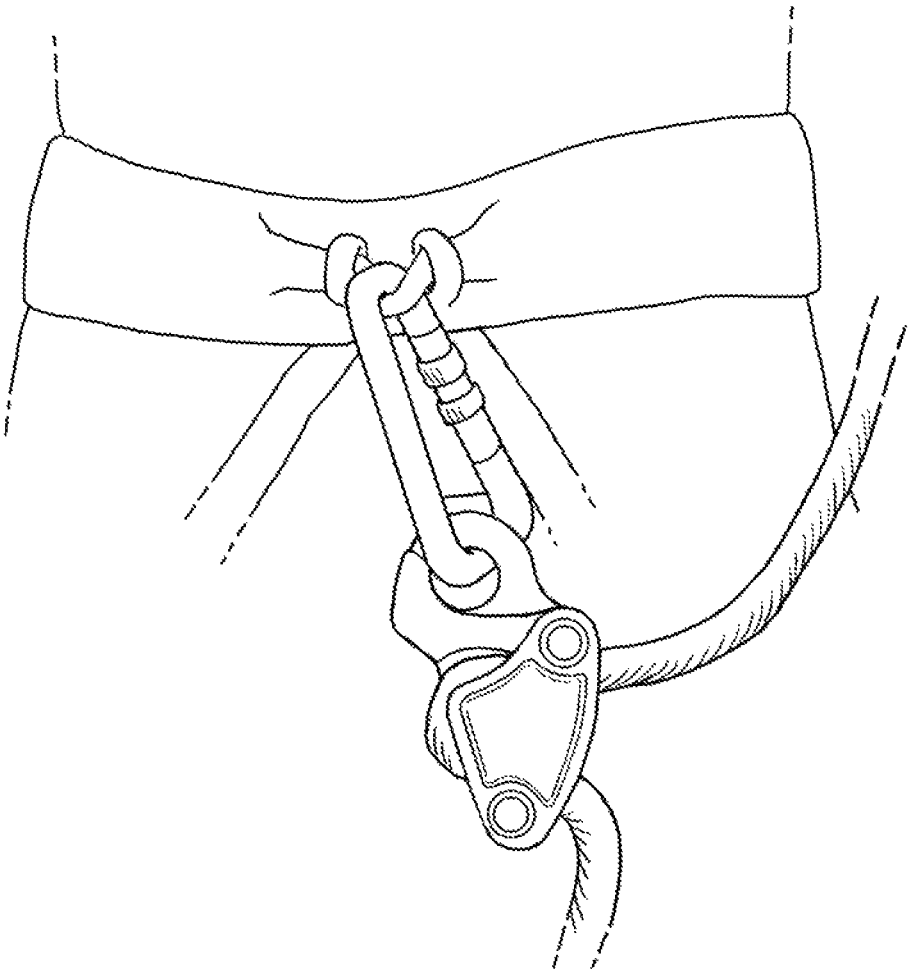
FIG. 1 is a representation of the device of the invention connected to the user's harness and ready for use.

In particular, reference numeral 1 represents a device for going down a rope 7 equipped with an anti-panic mechanism according to the invention.

The device 1 comprises a first 2 and a second plate 3, both fixed, substantially parallel to one another and connected together at one end through a lever member 4 and, at the opposite end, through a sliding profile 15 that has the function of a fixed pulley.

Figure 3:
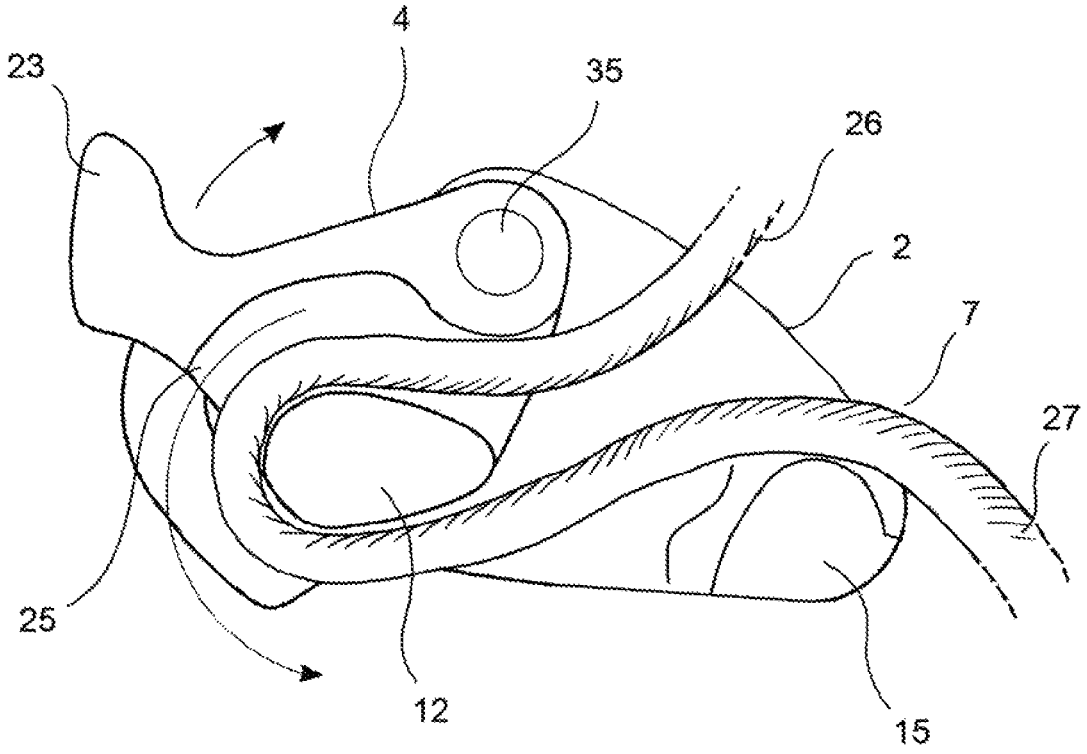
FIG. 3 shows the correct positioning of the rope in the device of the invention.

As shown in FIG. 3, on one face of the lever member 4 a recess 25 is formed with an arched shape and of a size so as to easily allow the user's rope 7 to pass. One end of the recess 25 is defined by a fixed pulley 12, having an oval or elliptical shape.

The two plates 2 and 3, when assembled together with the lever member 4, define a space $\alpha$ in which a path for the user's rope 7 is defined, as shown in FIG. 3.

The lever member 4 may be hinged on both of the plates 2,3 through a pin 35 that passes through holes 36, 37, 38 made in alignment in the first plate 2, in the lever member 4 and in the second plate 3, respectively. A tilting pivot (9) for the lever member (4) is thus defined.

In particular, the fixed pulley 12 may be arranged on a portion of the lever member 4 that does not comprise said tilting pivot (9) of the lever member 4.

The lever member 4 can thus rotate inside the space d about the tilting pivot 9, occupying a release position and a holding position of the user's rope 7.

The first plate 2 comprises a proximal portion and a distal portion.

The terms "proximal" and "distal" are meant with reference to the conditions of use of the device of the invention with respect to the user's body.

The proximal portion of the plate 2 comprises a flange 2' equipped with a through hole 13 for the connection of the device, for example through spring catches, with the user's harness (see FIG. 1).

In the plate 2 there is also an outer face 6 and an inner face 5, facing towards the spaced $\alpha$. Space $\alpha$ is further defined by the inner face 24 of the second plate 3.

The outer face 6 of the plate 2 comprises a housing, possibly closed by a cover, for a release mechanism and an anti-panic mechanism.

In the housing there is a housing lever 8, hinged to the pin 35 and able to move as a unit with the lever member 4, in contrast with an elastic means 28, typically a coil spring. For this purpose, the elastic means 28 is housed in a seat 28' and is inserted at one end in a tooth 39 positioned on the housing lever 8 and at the other end in a recess 40 of the seat 28'.

Figure 5:
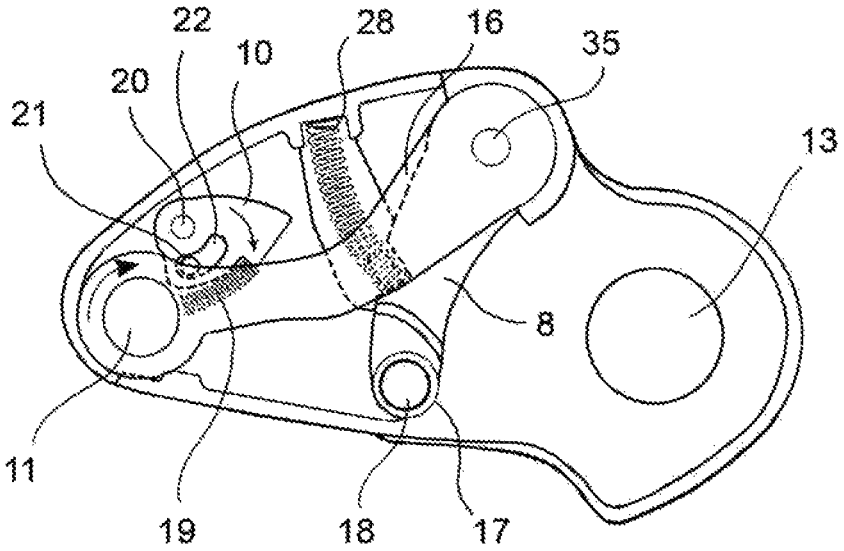
FIGS. 5 to 8 show the operation of the release mechanism of the rope and the anti-panic mechanism.
Figure 6:
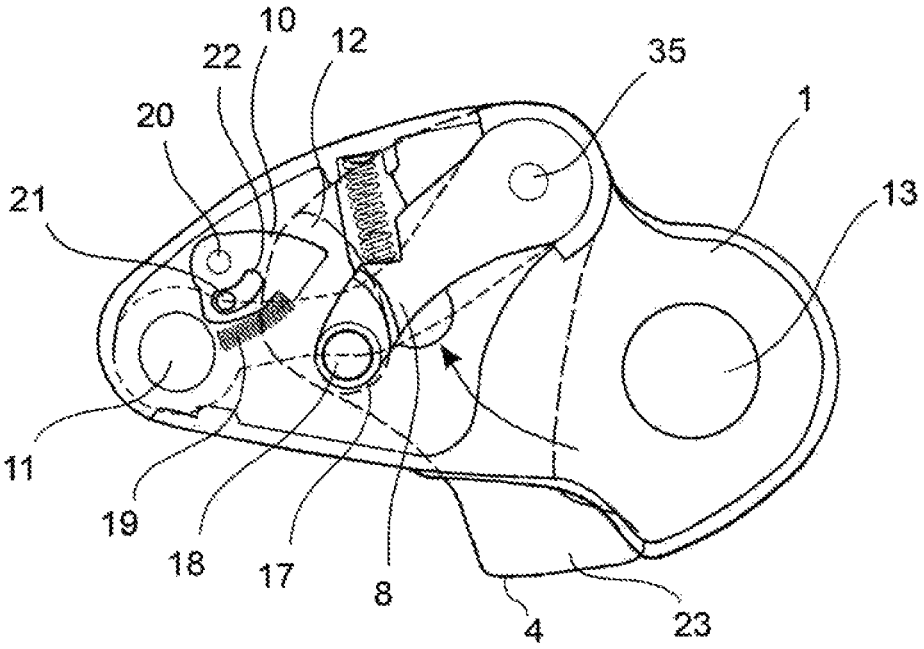

The housing lever 8 can thus tilt between a rest position, corresponding to the release position of the lever member 4—in which the elastic means 28 is in extended condition, shown in FIG. 5—and a work position, corresponding to the holding position of the lever member 4—in which the elastic means 28 is in compressed condition, shown in FIG. 6.

As is clear from the above description and from the Figures, such a mechanism allows the elastic return of the lever member from the holding position to the release position.

At the free end of the housing lever 8 there is a guide element 17, the function of which will become clear below.

According to a particular aspect of the invention, the guide and/or contact element 17 is able to rotate about a pin 18.

As stated earlier, the housing on the outer face 6 of the first plate 2 comprises a release mechanism and an anti-panic mechanism.

The release mechanism comprises a handgrip 16, capable of rotating in the direction indicated by the arrow in FIG. 5.

Figure 2:
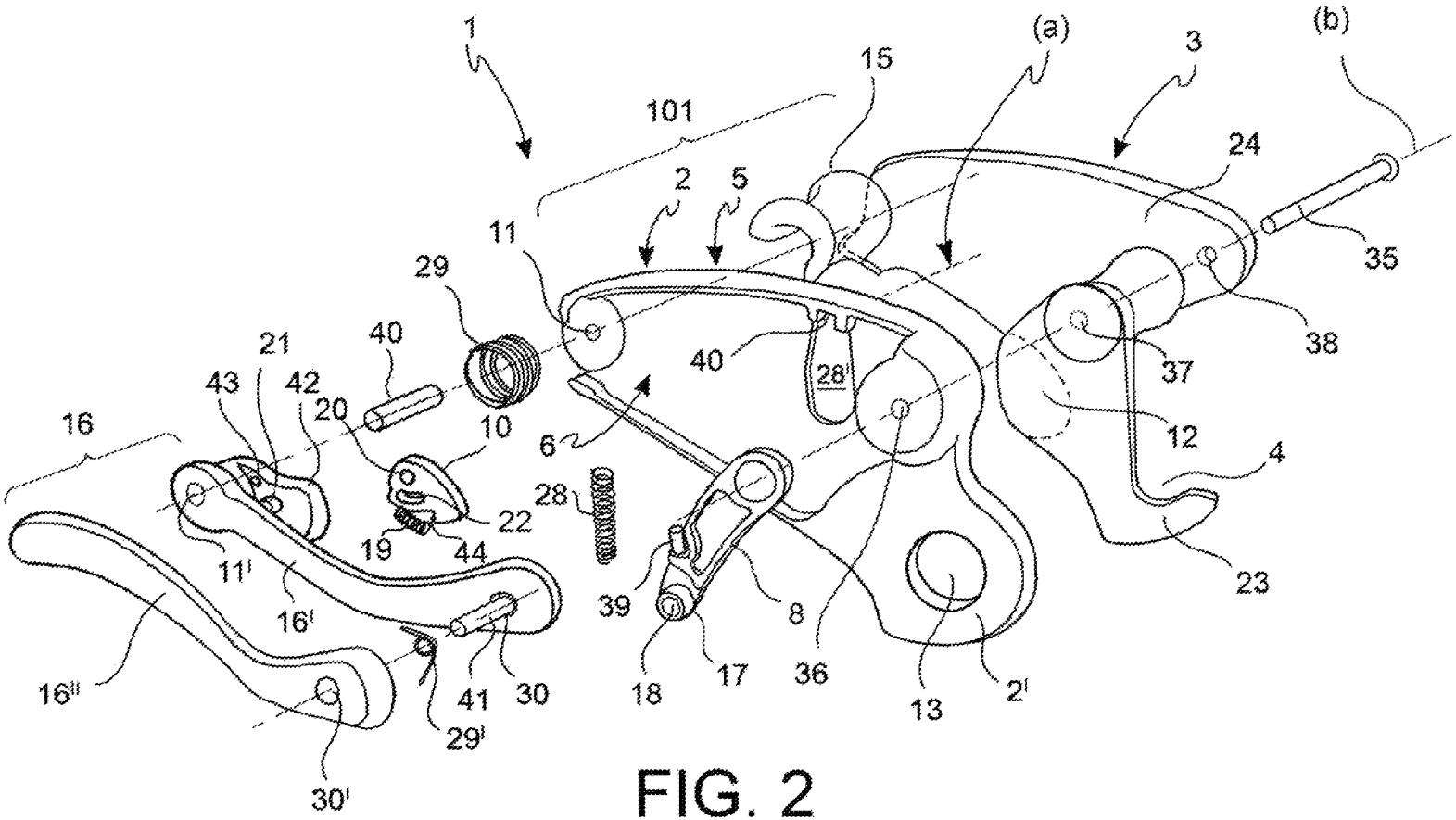
FIG. 2 is an exploded view of the device of the invention seen from the outer face of the first fixed flange.

In the embodiment shown in FIG. 2, the handgrip 16 consists of two lever mechanisms 16', 16" hinged in series. The first lever mechanism 16' is hinged to the distal portion of the first plate 2 through a pin 40 that inserts in suitable holes 11, 11' respectively positioned at said distal portion of the plate 2 and at a first end of said first lever mechanism 16'. The second lever mechanism 16" is on the other hand hinged to the first lever mechanism 16' at a second end of the latter, through a suitable pin 41 passing through respective holes 30, 30' made on the lever mechanisms 16', 16".

Elastic means 29, 29', such as torsion springs, are associated with the hinging points of the first lever mechanism 16' with the first plate 2 and of the second lever mechanism 16" with the first lever mechanism 16', so as to allow the elastic return of the handgrip 16 into rest position after its actuation.

The function of the double lever mechanism is to enhance the lever effect, while still keeping the device compact. In alternative embodiments, the handgrip 16 may consist of a single lever mechanism 16'.

The first lever mechanism 16' also may comprise a plaque 42 fixedly associated with the end of the lever mechanism that is hinged to the first plate 2. Such a plaque 42 has a pin 21 and a hole 43 positioned on it.

A cam member 10 may be hinged in a tilting manner to the plaque 42 through a suitable pin (not shown) passing through the hole 43 of the plaque 42 and through the hole 20 of the cam member 10.

The cam member 10 also may include a protrusion 44 on which an elastic means 19 presses, such as a compression spring. The elastic means 19 may press on a joining surface between the plaque 42 and the first lever mechanism 16' and thus allow the elastic return of the cam member 10 into its rest position after its actuation, as will be described more clearly hereafter.

The cam member 10 also may comprise a slot 22 intended to house the pin 21 of the plaque 42, which determines the tilting stroke of the cam member 10.

During the actuation of the handgrip 16, the cam member 10 interacts with the guide and/or contact element 17 of the housing lever 8, as will be described hereafter.

In certain embodiments, the lever member 4 comprises a tongue 23. The tongue 23 may have a profile with a shape such that, when the device 1 is inactive, it matches on top of the profile of the proximal portion of the first plate 2 around the hole 13 (FIG. 1).

"Inactive position" of the device refers to the device when it is already connected to the user's harness, and does not perform any locking function on the rope.

In this way, the lever member 4 does not hinder the insertion in the hole 13 of the spring catch connecting with the user's harness.

If the device is manoeuvred incorrectly, the tongue 23 at least partially blocks the hole 13, preventing its release from the harness and therefore its use.

In order to position a rope 7 in the device of the invention 1, the lever member 4 should be completely open towards the outside; of course, in order to do this it is necessary for the spring catch not to be inserted in the hole 13.

The rope 7 must then be inserted forming a U-shape around the fixed pulley 12 as indicated in FIG. 3.

Therefore, it is possible to make out a descending portion 26 (upstream) and an ascending portion 27 (downstream).

In particular, the downstream portion 27 will be housed between the fixed pulley 12 and the sliding profile 15.

The rope 7 coming out from the device 1 then passes onto the sliding profile 15 to fall downwards.

Once the rope 7 has been thus positioned, the lever member 4 must be closed by making it rotate in the opposite direction.

At this point, it is possible to connect the device 1 to the harness through a spring catch.

In this configuration (in which the rope is inserted in the device and it is connected to the user's harness), the opening of the lever member 4 is advantageously prevented thanks to the tongue 23 that goes into abutment against the spring catch inserted in hole 13.

Therefore, it is impossible for the rope 7 to come out accidentally.

Once the device 1 has been thus arranged, it can be used by the mountaineer to secure a companion or to go down the rope.

Figure 4A:
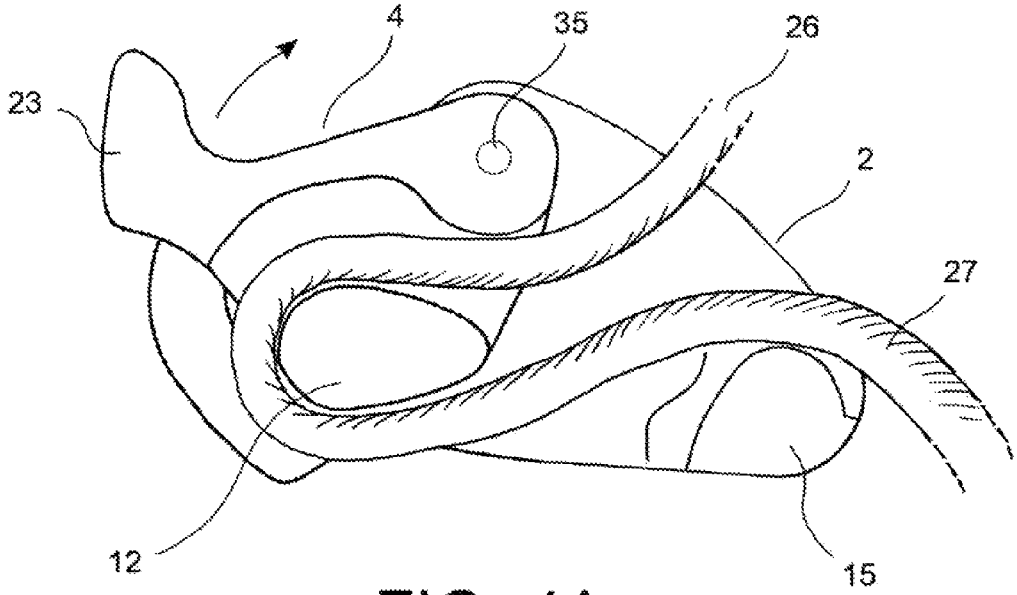
FIGS. 4A and 4B show the respective open and closed positions of the mobile flange.
Figure 4B:
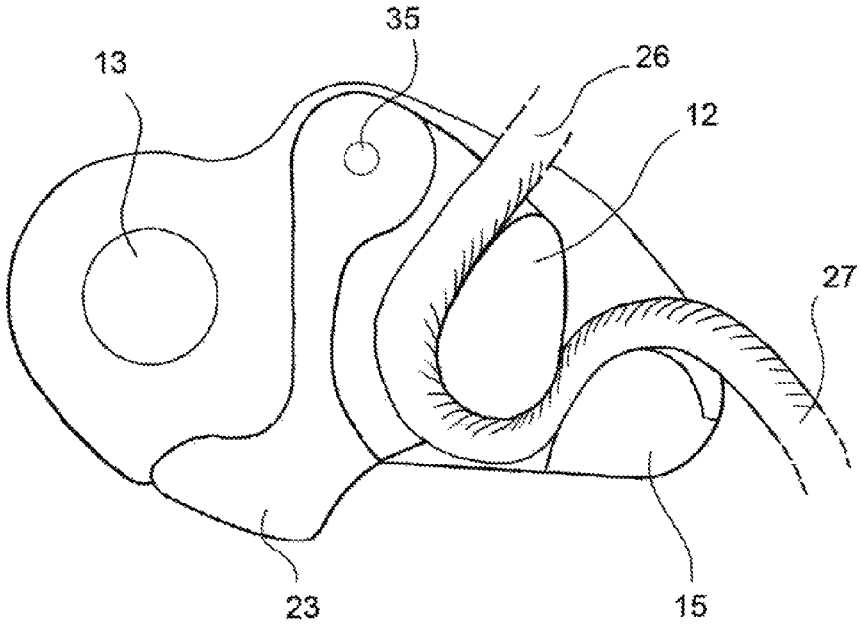

In particular, the operation of the device is such that, at the moment when a traction force acts on the upstream portion of rope 26, the tension created on the rope 7 itself determines the closing of the lever member 4 according to the direction indicated by the arrow in FIG. 4B.

In this way, the rope 7 is locked between the fixed pulley 12 and the sliding profile 15.

As described above, the housing lever 8 moves as a unit with the lever member 4; therefore, in the tension conditions described above, the housing lever 8 will tilt from the rest position to the work position according to the direction indicated by the arrow in FIG. 6.

In conditions of use, the tension generated on the rope upstream 26 is represented by the weight of the climber going down or by the stress due to the falling or temporary stopping of the leader of the line.

Such a force, therefore, opposes and blocks the sliding of the rope.

In contrast, at the moment when the tension that acts on the rope upstream 26 falls below a certain threshold, for example when the second climber on the line gives rope to the first companion who is moving along, the opposite situation occurs.

The lever member 4, no longer subject to tension or, in any case, subject to a lower tension, opens towards the outside, thus releasing the locking on the rope.

In particular, the opening movement of the lever member 4 is possible thanks to the elastic means 28 that acts on the housing lever 8 and tends to keep it in the rest position.

The tension on the rope that passes through the device in its use as insurer and/or descender, typically decreases in rest (stopped) conditions or, furthermore, in descending sections characterised by a smaller slope.

The opening of the lever member 4, however, can also be forced into the locked conditions of the rope 7, i.e. despite the tension acting on the rope.

This is possible due to the activation of the release mechanism with which the device 1 of the invention is provided.

As described above, in the locked conditions, resulting, for example, from someone falling while climbing on a line, the tension that acts on the rope 26 determines the closing of the lever member 4 in the holding position; at the same time, the housing lever 8 is in a work position.

At this point, when descending, the user can actuate the handgrip 16 determining the rotation of the release element 10 in the direction indicated by the arrow in FIG. 5. In this way, the cam member 10 acts on the guide element 17 of the housing lever 8, pushing it towards the rest position. Otherwise, in the case of use of the device of the invention as an insurer, the second on the line can act on the handgrip 16 to open the cam member 10.

Consequently, a corresponding outward rotation of the lever member 4 occurs, which releases the locking on the rope 7 and allows it to slide. The descent of the climber as well as the continued progress of the climb are therefore allowed.

It should be noted that the more the handgrip 16 is rotated, the more the open lever member 4 is opened and the more the rope 7 can easily slide.

However, for obvious safety reasons, the complete opening of the lever member 4 should be avoided, since it would allow the rope to slide freely.

An expert user is normally able to act on the handgrip suitably adjusting the speed of descent. However, there may be circumstances in which the user is not in full control of the descent device.

For this reason, the device of the present invention 1 is equipped with a so-called "anti-panic" mechanism.

Figure 6A:
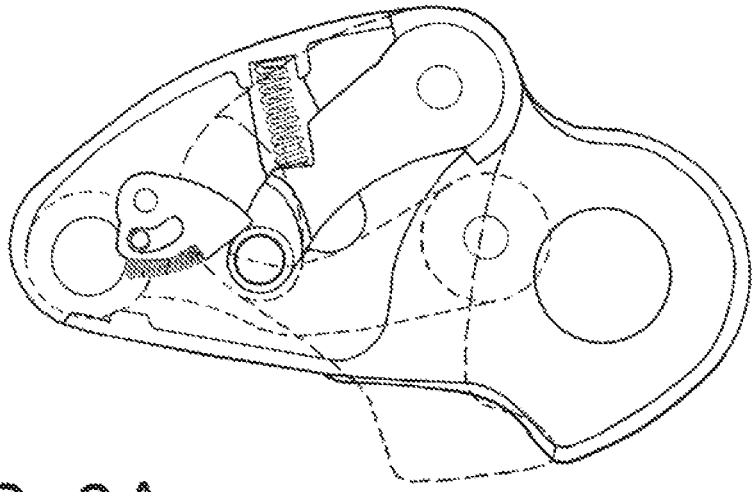
Figure 6B:
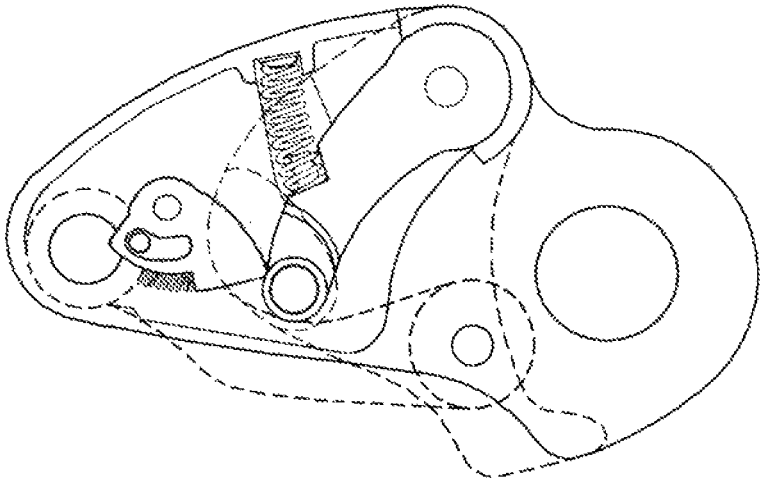

As described above, in the locked conditions the actuation of the handgrip 16 determines the movement of the cam member 10 and its interaction with the guide element 17 of the housing lever 8 that rotates towards the open position, as shown in FIG. 6A.

Figure 7:
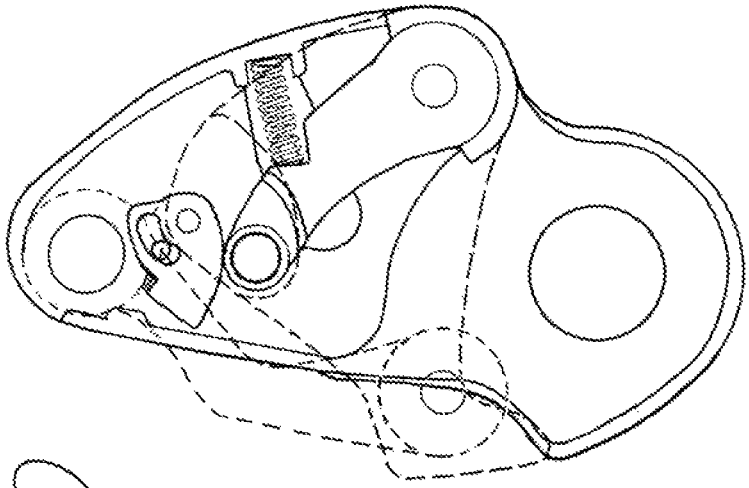
Figure 8:
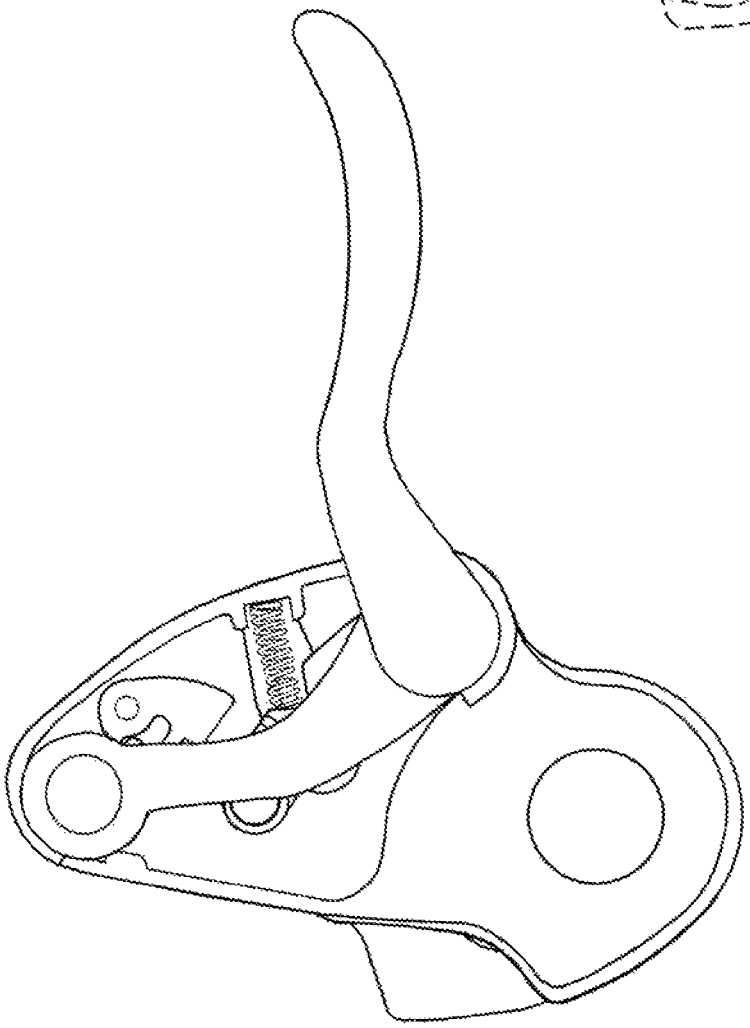

Further actuation of the handgrip 16, which can for example occur in abnormal or accidental conditions, causes the cam member 10 to escape from the interaction with the guide element 17 and causes the consequent return of the housing lever 8 into the work position, since the rope 7 continues to exert the closing traction of the device (FIGS. 7 and 8).

Such escaping is made possible by the rotation of the cam member 10 about the hinging axis.

The decoupling thus obtained between the cam member 10 and the housing lever 8 leads to the lever member 4 being subjected only to the tension exerted by the rope 7 and thus no longer also the opposing force exerted by the user through the handgrip 16.

Consequently, the lever member 4 rotates towards the holding position, locking the rope 7.

Therefore, advantageously, the anti-panic mechanism prevents the continuous activation of the handgrip 16 leading to the complete opening of the lever member 4.

The release mechanism may be reset thanks to the elastic means 29, which tend to take the handgrip 16 back into the initial position, and to the tilting of the cam member 10 in contrast with the relative elastic means 19, which allows the guide element 17 of the housing lever 8 to be overcome.

Therefore, the anti-panic device of the present invention is automatically "reset" after each activation without any movement being required from the user.

There are many advantages of the device of the invention.

First, the devices can be used not only as an insurer but also as a descender.

It is not difficult to understand the usefulness and also the convenience from the economic point of view of having a tool available with dual functions.

In use as an insurer, in particular, the device will be connected to the harness of the person who secures a descender or the first on the line, connected to the upstream end of the rope.

While moving forward, the absence of forces acting on the upstream portion of rope ensures that the lever member is in release position, allowing the rope to slide.

On the other hand, in the case of falling, the weight of the climber produces a tension on the rope upstream, which causes the rotation of the lever member into locking position of the rope. Such locking is carried out in the absence of active participation of the person securing his companion and, therefore, it is much safer than other systems known in the field. One only has to consider the use of the constrictor knot.

Numerous advantages derive from the particular configuration of the device of the present invention, which is very manageable, easy to hold and manoeuvre.

It also should be noted that during use, the movement of the lever member, the release mechanism of the rope and the anti-panic mechanism, cannot be blocked by the user's hands; advantageously, therefore, the operation of the device cannot be compromised.

Moreover, the risk of skin being "pinched" during use due to the movement of the lever member is reduced.

The fact that the release mechanism and the anti-panic mechanism are housed outside, for example, in a seat closed and protected by a cover, eliminates the possibility of the mechanisms being able to be worn or ruined by external agents (for example dust) or damaged from prolonged use.

Even altering or tampering with the device by a user is in this way advantageously prevented.

According to a further advantage, in devices according to the present invention the lever member that determines the locking of the rope has a low freedom of rotation, since it is restricted to the movement of the lever.

Moreover, the wide contact surface between the device and the rope allows greater control of the movements thereof, maximising the friction forces in play.

Moreover, thanks to the tongue that abuts against the spring catch connecting to the user's harness, the lever member will be advantageously prevented from opening and the rope will advantageously be prevented from coming out from the device, a situation that could be very serious and even fatal for the climber.

Furthermore, thanks to the particular configuration of devices according to the present invention, the way in which the rope should be inserted is very intuitive. For this purpose, as a further precaution, on the outer face of the second plate, it will be possible to apply writing or drawings such as to indicate to the user where the rope goes. Given that the second plate is fixed, the possibility of producing confusion or an error from the user is very limited.

As described above, the lever member that allows the rope to be stopped operates by actuation of the handgrip, which acts on the lever. Advantageously, such an indirect coupling between handgrip and lever member reduces the length of the lever when not in use, allowing greater compactness of the device, as well as reducing the force necessary to actuate it.

With regard to the anti-panic mechanism with which the present device can be equipped, it advantageously can be activated immediately after each actuation. Indeed, it is of the so-called "immediate-resetting" type. Therefore, the climber who already finds himself in difficulty does not have to remember any particular movement to activate the anti-panic system, which will therefore be readily available.

From the description provided above of the descent devices according to the present invention a person skilled in the art, in order to satisfy contingent and specific requirements, can bring numerous modifications, additions or replacements of elements with other functionally equivalent ones, without however departing from the scope of protection of the attached claims. Each of the characteristics described as belonging to a possible embodiment can be made independently from the other embodiments described.

The invention claimed is:

1. A self-locking device configured to secure and lower a user along a rope, the self-locking device comprising:

a body comprising a first plate and a second plate, both of the first and second plates being fixed substantially parallel to one another and connected together at one end through a lever member hinged between both of the plates via a first pin defining a first axis, so that when assembled, said plates define a space in which a path for the rope is defined, the lever member being configured to pivot around the first axis between a released position of said rope and a holding position of said rope, the lever member further comprising a fixed pulley configured to clamp said rope against the body to prevent movement of the rope when in said holding position, and configured to unclamp said rope to allow movement through said path when in the release position, wherein said rope is configured to slide on the fixed pulley about a second axis which is offset with respect to said first axis;

said first plate comprising an inner face and an outer face, said outer face comprising a housing having a release mechanism configured to move the lever member from the holding position to the release position after the rope has directly moved the lever member into the holding position as a result of a user falling;

the release mechanism comprising:

a housing lever having a second pin on a free end of the housing lever, a guide element located on the free end and configured to rotate about the second pin, a first elastic element applying force onto said housing lever for returning the lever member from the holding position to the release position, wherein the housing lever is configured to move as a unit with the lever member;

a handgrip comprising a plaque, the plaque having a plaque pin;

a cam member having a slot and a protrusion, wherein the plaque pin is housed in the slot of said cam member, a second elastic element applying force onto the protrusion which biases the cam member to pivot away from the plaque, wherein the cam member is hingedly connected to the plaque in order to pivot with respect to the plaque and interact with the guide element of the housing lever;

wherein, when in the holding position, rotating the handgrip a first distance causes the cam member to rotate the housing lever to rotate the lever member toward the release position until said rotating of the handgrip reaches a farther threshold distance from the first distance to cause the lever member to return to the holding position when the rope is applying force to rotate the lever member toward the holding position.

2. The device of claim 1, wherein said first plate comprises a proximal portion which comprises a flange comprising a through-hole for connection of the device with a user's harness.

3. The device of claim 2, wherein the lever member comprises a tongue having a profile shaped so that when the device is in an inactive position, the tongue prevents opening of the lever member.

4. The device of claim 1, wherein said first plate and said second plate are connected together through a sliding profile on a side of the body opposite to the lever member.

5. The device of claim 1, wherein the second elastic element applies force on a joining surface between the plaque and the handgrip.

6. The device of claim 1, wherein a third elastic element is associated with a hinging point of a first lever of the handgrip and the first plate, wherein a fourth elastic element is associated with a second lever of the handgrip and another hinging point of the first lever of the handgrip, both of the third and fourth elastic elements enabling an elastic return of the handgrip to a rest position.

* * * * *